US011856374B2

(12) United States Patent
Talbi

(10) Patent No.: US 11,856,374 B2
(45) Date of Patent: Dec. 26, 2023

(54) ACOUSTIC AND ILLUMINATING RECESSED ASSEMBLY

(71) Applicant: Aziz Talbi, Davenport, IA (US)

(72) Inventor: Aziz Talbi, Davenport, IA (US)

( * ) Notice: Subject to any disclaimer, the term of this patent is extended or adjusted under 35 U.S.C. 154(b) by 0 days.

(21) Appl. No.: 16/274,267

(22) Filed: Feb. 13, 2019

(65) Prior Publication Data

US 2020/0260181 A1 Aug. 13, 2020

(51) Int. Cl.

| | |
|---|---|
| ***H04R 3/00*** | (2006.01) |
| ***F21V 33/00*** | (2006.01) |
| ***F21V 7/04*** | (2006.01) |
| ***H04R 1/02*** | (2006.01) |

(52) U.S. Cl.

CPC ..... *H04R 3/00* (2013.01); *F21V 7/04* (2013.01); *F21V 33/0056* (2013.01); *H04R 1/025* (2013.01); *H04R 1/026* (2013.01); *H04R 1/028* (2013.01); *H04R 2201/021* (2013.01); *H04R 2420/07* (2013.01)

(58) Field of Classification Search

CPC ..... H04R 1/025; H04R 1/026; H04R 1/028; H04R 2201/021; H04R 2420/07; H04R 3/00; F21V 33/0056; F21V 7/04

USPC ..... 381/332

See application file for complete search history.

(56) References Cited

U.S. PATENT DOCUMENTS

2019/0113220 A1* 4/2019 Haase ..... F21V 29/713

* cited by examiner

*Primary Examiner* — Paul Kim

(74) *Attorney, Agent, or Firm* — Dykema Gossett PLLC

(57) ABSTRACT

At least one embodiment of the current invention provides a wireless audio assembly for use with recessed lighting fixtures and comprising: a wireless speaker, a powerbase module, a mounting support and a frame extension. The wireless audio assembly is attached to an existing recessed light, gets its power from recessed light power lines and has an opening in the center with a concave surface that appears as a continuation to the recessed light center opening.

14 Claims, 2 Drawing Sheets

ACOUSTIC AND ILLUMINATING RECESSED ASSEMBLY

CROSS REFERENCE TO RELATED APPLICATION

This application claims benefit of U.S. Provisional Application Ser. No. 62/632,337 filed Feb. 19, 2018.

FIELD OF THE INVENTION

The present invention relates generally to a wireless audio assembly and, more particularly, relates to a wireless speaker that can be easily assembled and suspended off existing recessed light fixture.

BACKGROUND OF THE INVENTION

Music has always been an integral part of life. Music can provide comfort, a distraction, or simply create a relaxing atmosphere. Music can be played using various equipment including but not limited to portable speakers, floor-standing speakers, on-wall speakers, in-wall speakers or in-ceiling speakers.

While in-wall and in-ceiling speakers may require special installation and/or fixtures, the previously mentioned type of speakers may be installed and put to use in virtually no time.

In-ceiling and in-wall speakers present a much more practical and attractive option to add an audio system to any new residential or commercial building during construction. Running speaker wires to their destinations can be done more conveniently before the wallboards are installed. However, installing in-ceiling and in-wall speakers in an existing residential or commercial building, may present many challenges especially in routing wires to their destinations, after wallboards, power wires, plumbing or ductwork are installed. Installing in-ceiling or in-wall speakers to existing residential or commercial building may require extra craftsmanship and geometric precision and could be costly as wall and ceiling rework may be needed.

The principal object of this invention is to provide solutions to some of these problems in residential and commercial buildings. In one embodiment, the present invention aims to solve some of these problems by providing a wireless audio system that can be easily assembled to an existing light assembly. In an alternative embodiment, the present invention aims to solve some of these problems by providing an alternative assembly that can house an audio system and a light fixture to replace existing recessed light fixture.

SUMMARY OF THE INVENTION

Recessed lights, also known as can lights or downlights, are widely used in residential and commercial buildings. They present a practical and attractive option to add lighting to any residential or commercial space. They appeal to home owners and designers for the fact that they are embedded into the hollow opening of a ceiling and take up less visual space. They also appeal to home owners and designers for the fact that being recessed into ceilings gives the appearance of a continuous surface, and for their aesthetic versatility and appeal.

There are three parts to a recessed lighting fixture: housing, trim and bulb. The housing, which can be of different size and shape, is the fixture itself that is installed inside the ceiling and contains lamp socket/holder. The trim is the visible portion of the light that is affixed over the opening of the housing.

In most cases, a plurality of recessed lights is installed each covering a small angle of dispersion. The result is a balanced and better distributed ambient light throughout any residential or commercial space.

One primary object and feature of the present invention is to take advantage of installed recessed lights fixtures to add an audio assembly. In one embodiment, the present invention provides a wireless speaker that can be easily assembled to an existing recessed light assembly. In an alternative embodiment, the present invention provides an integrated wireless speaker and light assembly that can replace existing recessed light fixture. The result is in most cases, similar to recessed light installation, a plurality of wireless speakers that can each cover a small angle of dispersion to create a balanced and better distributed ambient surround sound throughout any residential or commercial space.

DETAIL DESCRIPTIONS OF THE INVENTION

All illustrations of the drawings are for the purpose of describing selected versions of the present invention and are not intended to limit the scope of the present invention.

Figure 1:
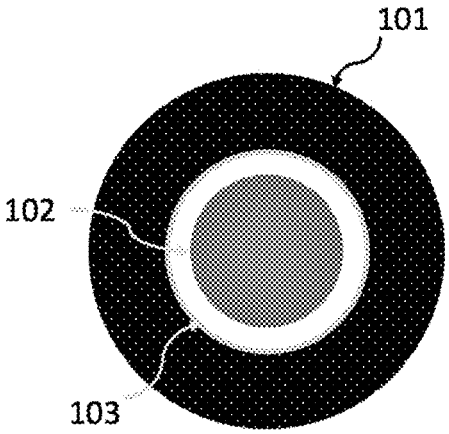
FIG. 1 illustrates a front view of an embodiment of the current invention comprising a recessed light fixture which item 104 is its canister and a wireless speaker 101.

In one embodiment of the current invention, as captured in FIG. 1, a wireless audio assembly is provided that comprises a wireless speaker, a powerbase module, an adjustable mounting lip and a frame extension.

Figure 2:
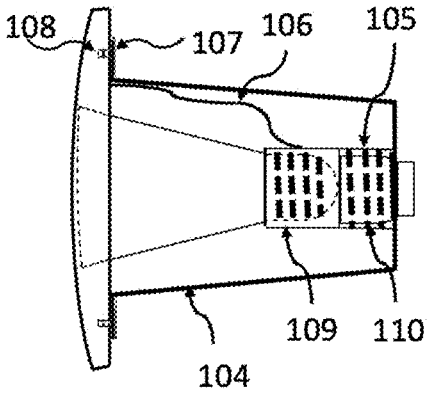
FIG. 2 illustrates a right perspective view of FIG. 1
Figure 5:
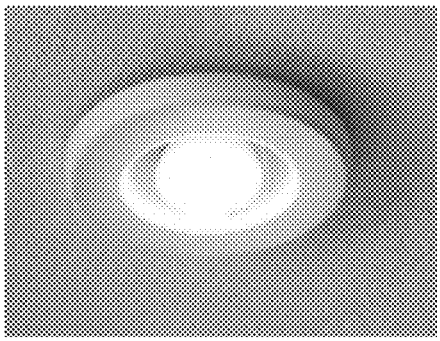
FIG. 5 is a picture of a prototype according to one embodiment of the current invention showing a wireless speaker attached to/suspended off a recessed light trim ring
Figure 6:
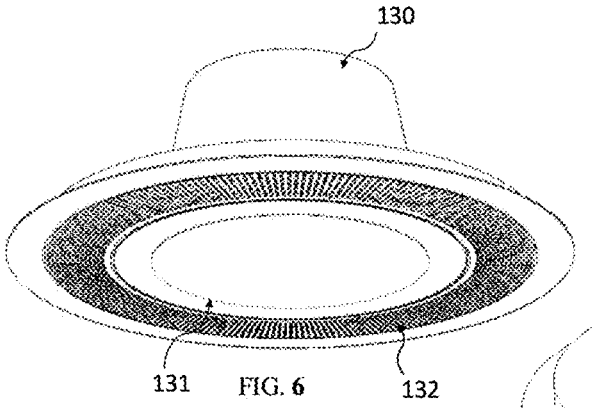
FIG. 6 illustrates an isometric view of an alternative embodiment of the current invention comprising a light fixture 130, light bulb 131 and an audio assembly 132
Figure 7:
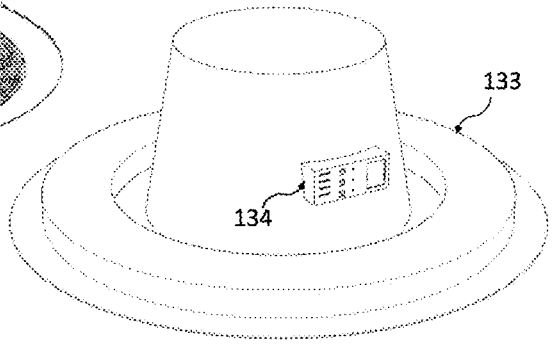
FIG. 7 illustrates another isometric view of the alternative embodiment of the current invention comprising an electrical hub 134 and showing section 133 where the speaker is installed
Figure 8:
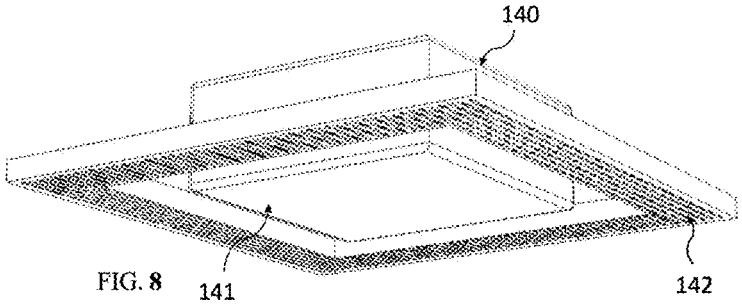
FIG. 8 illustrates an isometric view of an alternative embodiment of the current invention comprising a light fixture 140, light bulb 141 and an audio assembly 142

The wireless speaker 101 is attached to or suspended off an existing recessed light trim ring 107 via an adjustable speaker mounting lip 108 that slides behind the recessed light trim ring and locks in place. Other type of fasteners including but not limited to screws, retaining clips or magnets can also be used. The wireless speaker 101 is positioned in a way that its center opening is aligned with the recessed light canister 104 center opening. The result is the concave surface of the speaker to appears as a continuation to the recessed light opening as shown in FIG. 2 and FIG. 5.

Furthermore, the speaker comprises a speaker frame extension/adapter that allows for a single speaker to be used with different size and shape recessed light 130 and 140. In the case a wireless speaker is installed on a recessed light of smaller canister opening, a frame adapter is installed to fill in the gap and allow its concave surface to appear as a continuation to the recessed light opening as shown in FIG. 2 and FIG. 5. In the case a wireless speaker is installed on a recessed light with square canister, a frame adapter is installed to fill in the gap and allow its concave to match that of the recessed light canister.

In one embodiment, the powerbase module 105 has two ends and is used to supply power to speaker 101 via wire bundle 106. The powerbase module has at one end a standard light bulb thread 110 so it can be screwed into a standard light bulb socket which is connected to a standard A.C. power source. The powerbase is also fitted, at a second end, with internally threaded light bulb socket 109 which is adapted to receive standard light bulbs.

Furthermore, according to one embodiment of this invention, the powerbase can independently switch power ON and OFF to light bulb 102 and wireless speaker 101. Requests to turn ON and OFF can be made via various devices including but not limited to toggle switch, smart phone or a remote control.

In addition, the user can install multiple wireless speakers in a single room or in multiple rooms for a multi-room configuration to enjoy the surround sound or to project the sound for a larger audience (music, announcements . . . etc.) in the case of schools or offices for example. Playing audio can be done via various devices but not limited to smart phone, a computer or a virtual assistant device like Siri, Alexa or google assistant.

Furthermore, the wireless audio assembly has an opening in the center with a concave surface that appears as a continuation to the recessed light center opening. In certain cases, and if needed, a light reflector can be installed on the speaker center concave surface 103 to reinforce light intensity.

According to the current invention, the speaker can vary in size, to meet desired audio power level, without being bound by the size of the recessed light internal canister space and without impacting the function of the existing bulb performance. The wireless speaker size can vary as more speaker power is desired to accommodate for different size and different number of horn used.

Figure 3:
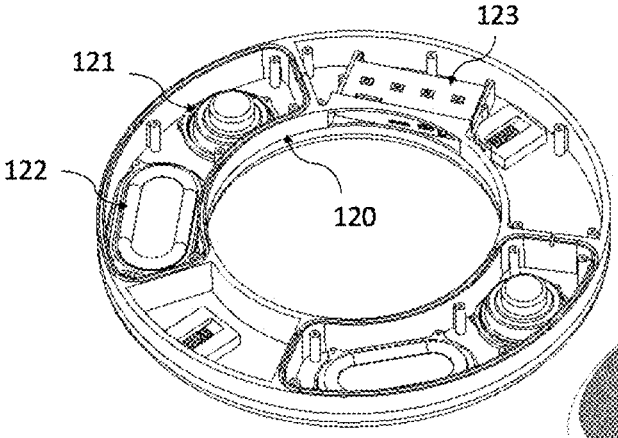
FIG. 3 illustrates an isometric view of an embodiment of the current invention comprising a speaker assembly with 2 compartments. Each compartment houses a horn 121 and a corresponding diaphragm 122. The figure also shows an audio receiver printed circuit board 123.
Figure 4:
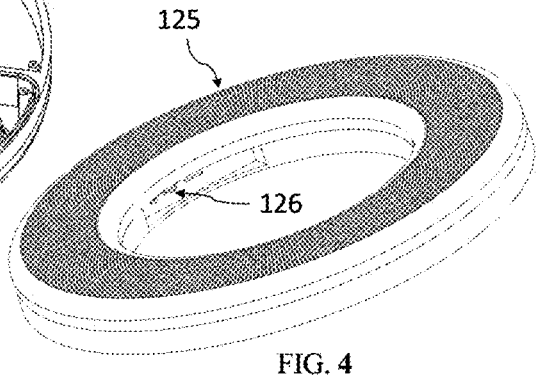
FIG. 4 illustrates an isometric view of an embodiment of the current invention comprising a speaker cover 125 and an electrical connector 126

In addition, according to the current invention, the wireless speaker can be configured into single or multiple compartments where each compartment houses a pair of horn 121 and diaphragm 122 as show in FIG. 3.

It is another objective of the present invention to provide a decorative speaker cover 125 that incorporate various themes including but not limited to multi-color lights and imprinted graphic covers.

In an alternative embodiment, the current invention provides an integrated light/speaker recessed assembly combining a light fixture and a speaker assembly. The recessed assembly houses a light fixture 130 and 140 and a speaker assembly 132 and 142 in a single or modular fixture to provide lighting and audio needs to any residential or commercial space. In the case of a new construction, the integrated light/speaker assembly is installed like any other recessed light. In an existing residential or commercial building, the existing recessed light is removed and its opening is adjusted to accommodate for the new light/speaker embodiment. An integrated light/speaker assembly will allow the speaker assembly to be flushed with ceiling or a wall and to reuse the existing wiring that was initially installed.

According to the current invention, the integrated light/speaker assembly may come in different embodiment shapes like circular 130 and square 140

According to current invention, the integrated light/speaker assembly comprises an in-ceiling/wall cavity 133 to house a speaker and allow it to be flushed with trim.

In the case of the integrated light/speaker assembly, other devices can also be installed like a projector or a smoke detector.

Furthermore, in one embodiment of the current invention, a voltage rail is used to provide a method for an easy speaker installation and eliminate the need for wiring. Power connection will be made when the speaker is inserted in its cavity.

The current invention, allows the purchase and installation of speakers and lights assemblies independently. The result is a failure or an upgrade of one does not require the unnecessary purchase/replacement of the other.

Furthermore, in one embodiment of the current invention, a power/signal hub 122 is used to provide power to speaker system, signal and signal processing via various devices like a wireless router. Power/signal hub may consolidate some processing power to allow for connected devices to share its capabilities and for those devices to be smaller in size.

It is also another object of the present invention to provide decorative speaker cover that incorporates various themes including but not limited to multi-color lights and imprinted graphic covers.

What is claimed:

1. A wireless audio system for use with recessed lighting fixtures, the system comprising:

a mounting support comprising a mounting lip, wherein the recessed light fixture comprises a recessed light canister embedded into a hollow opening within a ceiling and an outermost trim disposed radially outward the recessed light canister and the opening, wherein the mounting lip is configured to couple the mounting support to a distal end of the recessed lighting fixture by sliding behind the outermost trim to lock in place;

a wireless speaker configured and arranged to be directly coupled to the mounting support and positioned external a cavity of the recessed light fixture and radially outward of the cavity of the recessed light fixture, the outermost trim, and the hollow opening; and a powerbase module configured and arranged to be mechanically coupled between and to a light bulb socket of the recessed light fixture and a light bulb, and to transmit power from the light bulb socket to the light bulb and the wireless speaker.

2. The system of claim 1, wherein the system is configured and arranged to be attached to or suspended from a recessed light fixture.

3. The system of claim 1, further including an annulus in the system configured and arranged when installed in a recessed light fixture to continue an opening in the recessed light fixture.

4. The system of claim 3, further including a speaker center concave surface including a light reflector.

5. The system of claim 1, wherein the wireless speaker is configured and arranged to receive power from a recessed light fixture via the powerbase module.

6. The system of claim 1, the powerbase module configured and arranged to supply power and signal to the wireless speaker and a light bulb communicatively coupled to the powerbase module.

7. The system of claim 1, wherein the powerbase module is configured and arranged to independently switch power ON and OFF to a light bulb and the wireless speaker.

8. The system of claim 1, further including a frame extension configured and arranged to be compatible with different size and shape of recessed light fixtures.

9. The system of claim 1, wherein the wireless speaker includes wireless circuitry configured and arranged to receive audio data from a remote controller and operate in conjunction with a plurality of other wireless speakers for a surround sound effect or to project the sound to a larger audience.

10. A recessed light and speaker combination fixture comprising:

a recessed light canister comprising an outermost wall, the recessed light canister configured to be placed within a hollow opening within a ceiling;

a bulb cavity within the recessed light canister configured and arranged to receive a light bulb, a speaker cavity configured and arranged to receive an audio assembly, the speaker cavity positioned radially outward and separated from the outermost wall of the recessed light canister, a trim that encompasses at least a portion of the speaker, and a power-signal hub positioned radially outward from the outermost wall of the recessed light canister and configured and arranged to deliver power to the light bulb and the audio assembly.

11. The fixture of claim 10, can easily replace an existing recessed light by reusing existing installed power lines.

12. The fixture of claim 10, the fixture configured and arranged to be adjustable to fit different shape, size and theme applications.

13. The fixture of claim 10, wherein the fixture is configured and arranged to house the audio assembly flush with a ceiling or a wall.

14. The fixture of claim 13, further including a voltage rail configured and arranged to facilitate installation of a speaker without wiring and to deliver power to the speaker.

* * * * *